US005390814A

United States Patent [19]

Christine et al.

[11] Patent Number: 5,390,814

[45] Date of Patent: Feb. 21, 1995

[54] CONTAINER HAVING FITMENT

[75] Inventors: William Christine; Peter DeRaymond, both of Nazareth, Pa.

[73] Assignee: Inpaco Corporation, Nazareth, Pa.

[21] Appl. No.: 881,517

[22] Filed: May 7, 1992

[51] Int. Cl.[6] ..... B65D 90/04

[52] U.S. Cl. ..... 220/465; 156/293; 156/306.6; 222/105; 220/612

[58] Field of Search ..... 222/94, 105, 183, 386.5; 220/404, 465, 611, 612, 613; 156/293, 306.6

[56] References Cited

U.S. PATENT DOCUMENTS

| | | | |
|---|---|---|---|
| 3,166,189 | 1/1965 | Disston | 206/63.2 |
| 3,233,817 | 2/1966 | Casady | 220/465 X |
| 3,461,868 | 8/1969 | Palich | 128/214 |
| 3,773,047 | 11/1973 | Sneider | 128/232 |
| 3,946,936 | 3/1976 | Brown | 229/117.18 |
| 4,020,947 | 5/1977 | Roccaforte | 229/117.18 X |
| 4,523,691 | 6/1985 | Larkin et al. | 220/266 |
| 4,537,329 | 8/1985 | Norton | 220/465 |
| 4,548,601 | 10/1985 | Lary | 604/204 |
| 4,648,509 | 3/1987 | Alves | 206/459 |
| 4,708,260 | 11/1987 | Siegal et al. | 220/465 |
| 4,804,367 | 2/1989 | Smith et al. | 604/113 |
| 4,869,398 | 9/1989 | Colvin et al. | 222/83 |
| 4,921,138 | 5/1990 | Quinn et al. | 222/85 |
| 4,982,769 | 1/1991 | Fournier et al. | 141/98 |
| 5,033,647 | 7/1991 | Smith et al. | 222/94 |
| 5,042,682 | 8/1991 | Ritter et al. | 220/403 |
| 5,203,470 | 4/1993 | Brown | 220/462 |
| 5,237,735 | 8/1993 | Grossmann et al. | 156/293 X |

*Primary Examiner*—Allan N. Shoap
*Assistant Examiner*—Christopher McDonald
*Attorney, Agent, or Firm*—Hill, Steadman & Simpson

[57] ABSTRACT

A container for housing a liquid. The container including a fitment having barrier properties substantially equivalent to the container. To secure the fitment to the container, a sleeve is used to heat seal the fitment to the container. A check valve prohibits reintroduction of the liquid pharmaceutical into the container after dispensing through the fitment. Preferably, a second rigid container is provided for housing the container.

22 Claims, 4 Drawing Sheets

CONTAINER HAVING FITMENT

BACKGROUND OF THE INVENTION

The present invention generally relates to the packaging of liquid products. More specifically, the invention relates to flexible pouches including a fitment for packaging products such as liquid pharmaceuticals.

It is known to package fluids in containers. In the medical and pharmaceutical industry, it is known to package fluids in containers having a fitment or other access member. Generally, liquid pharmaceuticals are dispensed from a container through a spike connected to a fluid conduit or through a hypodermic needle. The spike or needle is inserted through the fitment to access the fluid within the container.

These containers are typically constructed from either plastic or glass. Due to their structure, often, such containers are not capable of withstanding physical abuse. Such abuse can occur during transportation of the container, or if the container is dropped. Such physical abuse can result in breakage or rupture of the container.

Additionally, such containers may also expose the liquid to environmental stresses, such as ultraviolet rays and/or oxidation. This can cause a degradation of the product. A further concern in constructing such containers is preventing the reintroduction of the liquid into the container so as to preserve liquid purity and sterility.

A number of containers for housing liquid products are known. For example, the following U.S. Pat. Nos. relate to such containers: 3,166,189; 3,461,868; 3,773,047; 4,523,691; 4,548,601; 4,648,509; 4,804,367; 4,869,398; 4,921,138; 4,982,769; and 5,042,682. Briefly, these patents relate to the following:

U.S. Pat. No. 3,166,189 to Disston relates to a catheterization package which is specially designed to cooperate with a pre-assembled catheter-tube-bag assembly contained therein. The package includes a container having a sleeve and a tray which holds several catheterization appliances and accessories. The sleeve and tray are formed from cardboard having a certain amount of stiffness with a notch in the tray to facilitate sliding of the tray from the sleeve.

U.S. Pat. No. 3,461,868 to Palich relates to compressible receptacles for dispensing fluid. An elastic translucent receptacle has a check valve controlled delivery member at one end and a check valve controlled vent member at the other end. The body of the receptacle is formed of a plastic with an outlet valve body at one end and an air inlet valve body at the other end.

U.S. Pat. No. 3,773,047 to Sneider relates to a disposable syringe in which a nozzle portion is detachably attached to an end closure member having a tubular portion and a cap portion. A flexible bag made of a thin plastic film is mounted on the tubular portion.

U.S. Pat. No. 4,523,691 to Larkin et al relates to a port structure for a container which allows piercing to be performed in an allegedly leak-free manner.

U.S. Pat. No. 4,548,601 to Lary relates to a pharmaceutical and hypodermic needle combination wherein a medication is contained within a non-resilient, highly flexible sack or inner container which is indirectly compressed by use of a resilient, comparatively rigid outer container. The injection device is fabricated by molding synthetic plastic materials.

U.S. Pat. No. 4,648,509 to Alves relates to a tamperproof package in which a first container has an article placed therein and is sealed at one end flap such that the opening of the end flap would indicate tampering. A pouch is made of a lightweight flexible material in which a second container of suitable semi-rigid material is enclosed. The second container has a heat-sealed top cover which when torn off indicates tampering.

U.S. Pat. No. 4,804,367 to Smith et al relates to a suspendable, thermally insulating jacket for I.V. fluid bags. A sheet of thermally insulated material encloses the bag, and a bag support hook attaches the jacket to the I.V. bag within a sheet.

U.S. Pat. No. 4,869,398 to Colvin et al relates to a liquid container packaged in a box having a removable handle which acts as a closure device for the opening and closing of the box. The container includes an inner bladder made of polyvinylchloride. The inner bladder is wrapped in a carbon dioxide/oxygen gas barrier. This gas barrier may be in the form of a plastic bag. The inner bladder has three ports for access to the stored liquid. The box is designed to support sufficient weight to allow stacking of several boxes with associated filled inner bladders. A cardboard box contains the inner bladder. The frontal face of the cardboard box has a lid with flaps designed to be inserted into the box to strengthen the side walls of the box. The flap on the lid opposite the hinge is secured by a simple handle. This end flap has two holes which correspond to two holes in the end face of the box.

U.S. Pat. No. 4,921,138 to Quinn et al relates to the administration of fluids from pre-filled shape retentive containers. A distensible hanger member is formed around only the end panels of the container to suspend the container in an orientation to define only a single uppermost corner and a single lowermost corner.

U.S. Pat. No. 4,982,769 to Fournier et al discloses a package container structure having an open end leading into an interior chamber with a package lid structure mounted over the open end of the package container structure in a sealed relationship with the interior chamber capable of moving into an opening relative thereto. The package lid structure is a shaped flat sheet of semi-permeable membrane type material capable of enabling the device to be sterilized after the package is assembled. The mounting of the package lid structure is typically performed by heat sealing. This is preferred when the structure is formed of a thermoplastic material which allows sterilization after completion of the package.

U.S. Pat. No. 5,042,682 to Ritter et al relates to an outer container for use with an inner flexible bag in a composite package adapted to hold and dispense liquids. The container includes a detachable tab in the bottom wall to provide access to a bag spout, and an integral, internal wedge-shaped ramp formed entirely from material of the bottom wall and adjacent side walls of the container. The ramp is located adjacent a lower rear corner of the container to help evacuate liquid from a bag positioned within the container. A filled bag is inserted into the container through an open end after the container has been substantially formed to hold the bag.

SUMMARY OF THE INVENTION

The present invention provides an improved package for storing and delivering liquid products.

In an embodiment, the present invention provides a container including a fitment. The container is constructed from a flexible plastic material and the fitment is constructed from a rigid material that is not easily heat sealed to the flexible plastic material. A plastic sleeve is provided to secure the fitment to the container. The sleeve is constructed from a material that is heat sealing compatible with the flexible plastic material and is secured to the fitment.

In an embodiment, the present invention provides an apparatus for storing and dispensing liquid comprising a pouch, constructed from an olefin that is constructed from heat sealable material, defining an interior for holding the liquid. A fitment is provided constructed from a rigid plastic. The fitment is thermally welded to the pouch by a sealing sleeve, of heat sealable plastic that is compatible with the plastic of the pouch. A rigid container, "box", is also provided for containing the pouch and at least a portion of the fitment and allowing the fitment to extend through a recess of a bottom wall of the box.

The present invention also provides a method for manufacturing a container having a fitment. The method comprising the steps of: creating a pouch from a flexible plastic material; creating a fitment from a rigid plastic material not easily heat sealable to the flexible plastic material; and securing the fitment to the pouch by use of a sleeve that can be heat sealed to the flexible plastic material and is secured to the fitment.

In a preferred embodiment, a check valve is provided that prevents the reintroduction of the liquid into the pouch. The valve permits fluid to be extracted from the pouch, but blocks the return flow of fluid into the pouch. A number of valve structures can be used including, for example: a flapper valve; or a ball check assembly.

In an embodiment, the invention provides a secondary container designed to permit the pouch to be used in the same manner as a bottle. The fitment is securely held in a recess at the end of the secondary container. The fitment and pouch, in this position, are protected from damage while remaining accessible to a user. In addition, the user can hold the secondary container while the liquid is being administered to the user through the fitment held in the pouch, or the secondary container may be suspended from a hook during administration of the liquid.

Additional features and advantages of the present invention are described, and will be apparent from, the detailed description of the presently preferred embodiments and from the drawings.

DETAILED DESCRIPTION OF THE PRESENTLY PREFERRED EMBODIMENTS

In accordance with the present invention, a packaging is provided for dispensing liquid products wherein the packaging is capable of withstanding physical abuse and protects the product from environmental stresses. In addition, the packaging is simple to use and restricts reintroduction of the dispensed product, or other liquid, into the pouch thereby maintaining product purity and sterility. Furthermore, the present invention allows a fitment to be used that can have barrier properties equivalent to the high barrier film used to construct the pouch.

Figure 1:
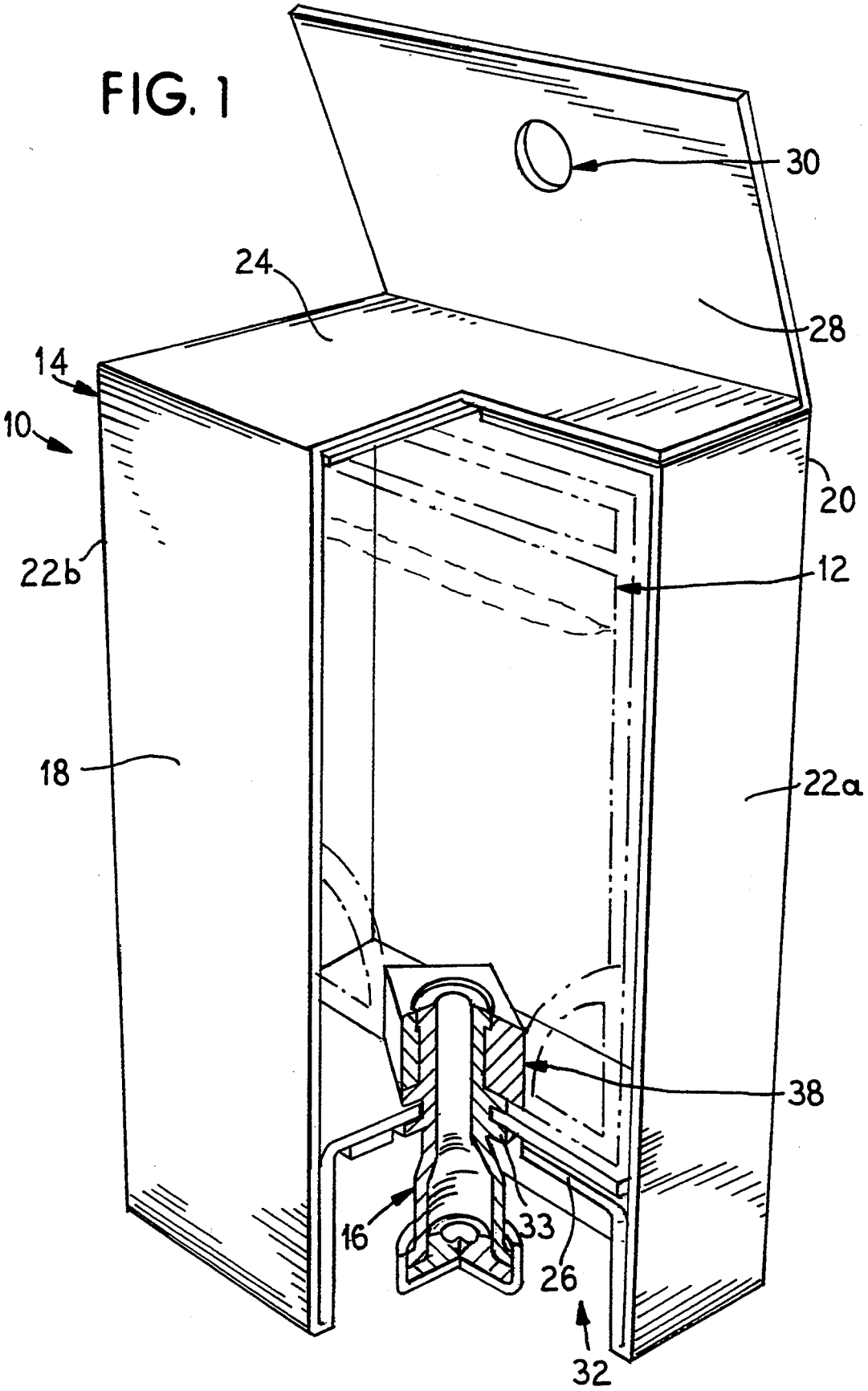
FIG. 1 is a partial sectional view of the packaging of the present invention.

Referring now to the figures, FIG. 1 illustrates a preferred embodiment of the packaging 10. The packaging 10 includes a pouch 12, a secondary container or "box" 14, and a fitment 16. Although the packaging 10 is designed so that it can be used with liquid pharmaceuticals and other medical products, other liquids can be housed in the packaging 10.

The pouch 12 is preferably formed from two sheets of flexible polymer film thermally welded into a desired shape. The flexible polymer film is chosen so that it provides sufficient barrier properties. Of course, if desired, the pouch 12 can be formed from one sheet of plastic folded over to create a container. The pouch 12 is sealed at its periphery such that a liquid contained therein will not leak through its periphery.

In constructing the pouch 12, any olefin material can be used that is heat sealable. Such materials include, for example, polyethylene.

A variety of methods are known for making such pouches 12. Likewise, a variety of shapes of pouches are known including pouches 12 having chevrons.

As illustrated, the pouch 12 and box 14 are dimensioned such that the pouch 12 can be positioned within the box 14 when the pouch 12 is filled with liquid. The box 14, as shown in FIG. 1, may be constructed of a rigid paperboard. The box 14 includes a front wall 18, a back wall 20, two side walls *22a* and *22b*, a top 24, a bottom 26 and a hanging flap 28. Preferably, the front wall 18 and the back wall 20 are identical, and the two side walls *22a* and *22b* are identical. While various sizes and shapes are contemplated, a typical wall is rectangular, and therefore, the resulting box 14 will be rectangular. The front wall 18 and the back wall 20 may interchangeably form the top 24.

Either the front wall 18 or the back wall 20 of the box 14 can include an aperture 30 to allow the box 14 to be suspended from a hook (not shown) or the like. For example, in the medical field, it is known to suspend IV containers from IV poles. The wall including the hole 30 in turn becomes the hanging flap 28. Although there are a variety of ways to make the box 14, if desired, the opposite wall may be creased and bent over to form the top 24. In addition, the two side walls *22a* and *22b* may be creased and bent over beneath the top 24.

The bottom 26 of the box 14 preferably includes a recessed portion 32. As illustrated, the recessed portion 32 allows the fitment 16, when the pouch 12 is located within the box 14, to extend at or within the volume of the recessed portion 32. The recessed portion 32 is formed by the front wall 18, the back wall 20, and the side walls *22a* and *22b*. Located within the recessed portion 32 of the box 14 is an opening 33 at a bottom thereof for allowing the fitment 16 to extend therefrom.

Due to its construction, the recessed portion 32 allows for the packaging 10 to be rested on its end without the fitment 16 contacting a surface. Likewise, the recessed portion 32 protects the fitment 16 from inadvertent contact.

Although a variety of methods can be used to create the box 14, preferably, the walls that define the bottom 26 are secured together to prevent the ends from opening and to secure the pouch 12 within the box 14. This prevents the pouch 12 from falling through the bottom 26 when the box 14 is being held by a user or suspended from the hanging hole 30. Likewise, the top 24 may be formed by adhering the ends of the side walls **22*a* and 22*b* and the end of the front wall 18. The back wall 20 with the hanging hole 30 (forming the hanging flap 28) may be adhered to the top 24** or merely creased and remain unsealed.

Figure 2:
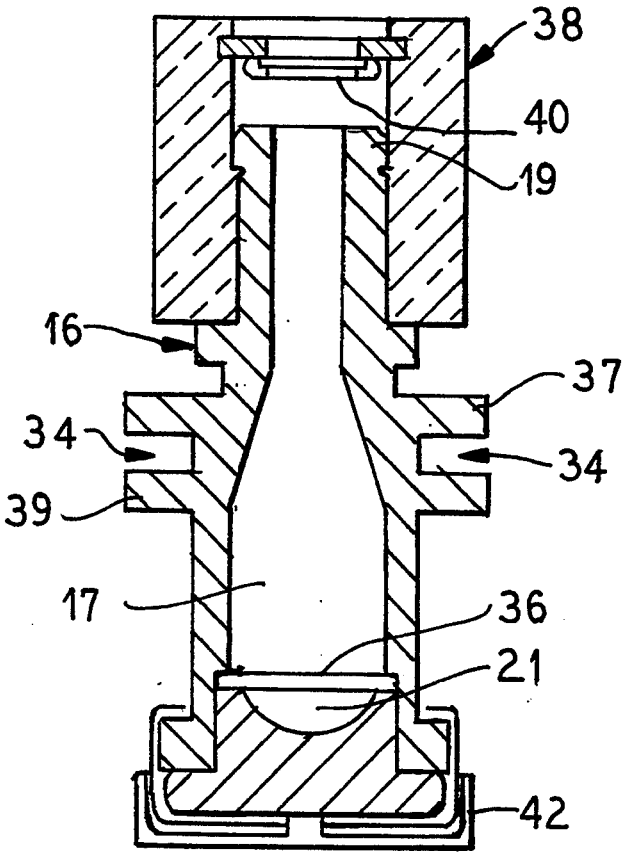
FIG. 2 is a sectional view of the fitment of the present invention with a flapper check valve for blocking fluid flow into the pouch.

FIG. 2 illustrates a sectional view of the fitment 16. The fitment 16 includes an aperture 19 located at one end of the fitment 16 and an aperture 21 located at a second end. A channel 17 is located therebetween. The aperture 21 allows the fitment 16, and thereby the pouch 12, to be accessed by a spike or needle.

Preferably, located within the channel 17 of the fitment 16 is a membrane 36. The membrane 36 forms a seal that prevents the liquid located within the pouch 12 from exiting the fitment 16. To access the pouch 12, a spike or needle must rupture the membrane 36. As is known in the art, to maintain sterility of the interior of the fitment 16, a stopper 42 or other fitment protector can be located over the aperture 21. Instead of a removable stopper 42, an injection site can be used to allow the insertion of a needle therethrough.

The fitment 16 is designed to be partially located within the pouch 12. The fitment 16, in the preferred embodiment illustrated, includes two flanges 37 and 39 that circumscribe the fitment 16. The flanges 37 and 39 define a slot 34. When the fitment 16 is secured within the pouch 12, the flanges 37 and 39 are located at a bottom thereof. The slot 34 is designed so that it will receive a portion of the structure of the box 14 that defines the opening 33 at the bottom of the box 14. This allows the fitment 16 to be securely received therein.

In providing an improved packaging 10, the fitment 16 is constructed from a high barrier material such as PETG or polybutylene terephthalate (PBT). Such materials allow the fitment 16 to have high barrier properties equivalent to the film used to construct the pouch 12, in contrast to typical fitments.

Unfortunately, such material is not easily heat sealable to the flexible plastic material, e.g., heat sealable olefins, that comprises the pouch 12. Pursuant to the present invention, to seal the fitment 16 to the pouch 12, a sealing sleeve 38 of heat sealable plastic, such as low density polyethylene, that is compatible from a heat sealing standpoint with the film of the pouch 12 is provided.

The sealing sleeve 38 is secured or coupled to the fitment 16 and is sealed to the pouch 12. The sleeve 38 may be sealed to the fitment 16 by various methods including direct injection molding, adhesive bonding, welding, or press fitting. Each method provides a secure, leak-free connection of the fitment body 16 to the sleeve 38 and to the pouch 12.

In an embodiment, the present invention provides means for preventing reintroduction of fluids into the pouch 12 through the fitment 16. To this end, a one-way check valve is provided. The one-way check valve may be defined by a variety of structures.

Referring to FIG. 2, in an embodiment, the sleeve 38 includes an integrally molded flapper valve 40. The flapper valve 40 prevents reintroduction of the liquid pharmaceutical into the pouch 12. However, the flapper valve 40 permits the liquid to be extracted from the pouch 12.

Figure 3:
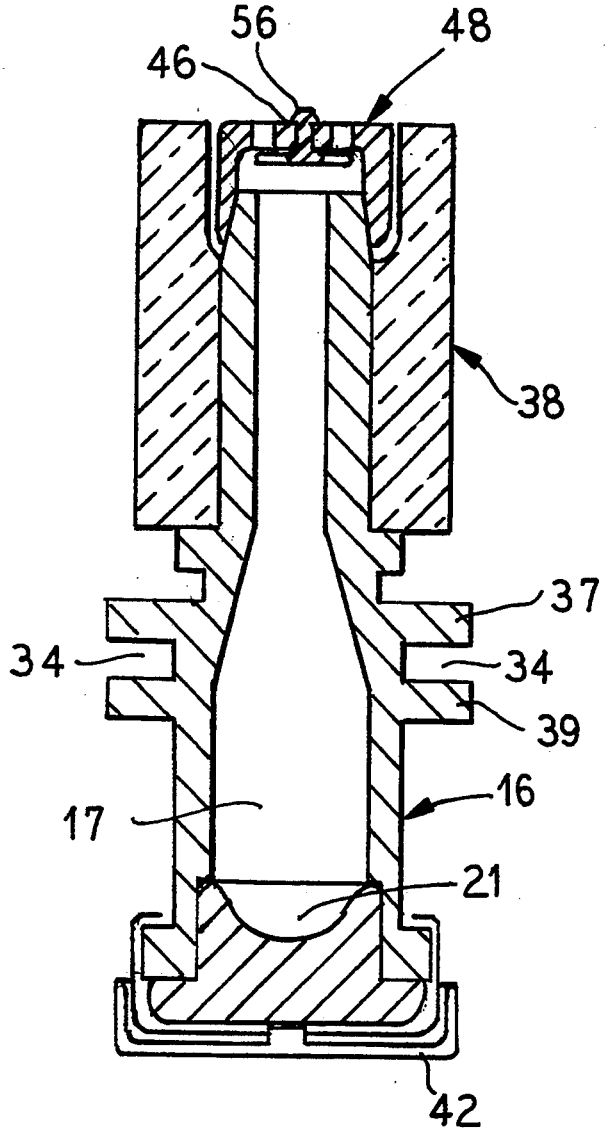
FIG. 3 is a sectional view of the fitment of the present invention with a rubber check valve flapper for blocking flow into the pouch.

FIG. 3 illustrates an alternate embodiment of the one-way check valve of the present invention. In this embodiment, a rubber check valve flapper 46 is located in the fitment 16. A valve flapper housing 48 encases the rubber check valve flapper 46 and may be ultrasonically welded to the fitment 16. Again, the rubber check valve flapper 46 allows fluid to be extracted from the pouch 12 through the fitment 16, but prevents the introduction of fluid into the pouch 12 through the fitment 16.

The rubber check valve flapper 46 may be included within the housing 48 and retained at the opening of the fitment 16 with a barb 56. As illustrated, the sealing sleeve 38 is attached to the fitment 16 to allow the fitment 16 to be secured to the pouch 12.

Figure 4:
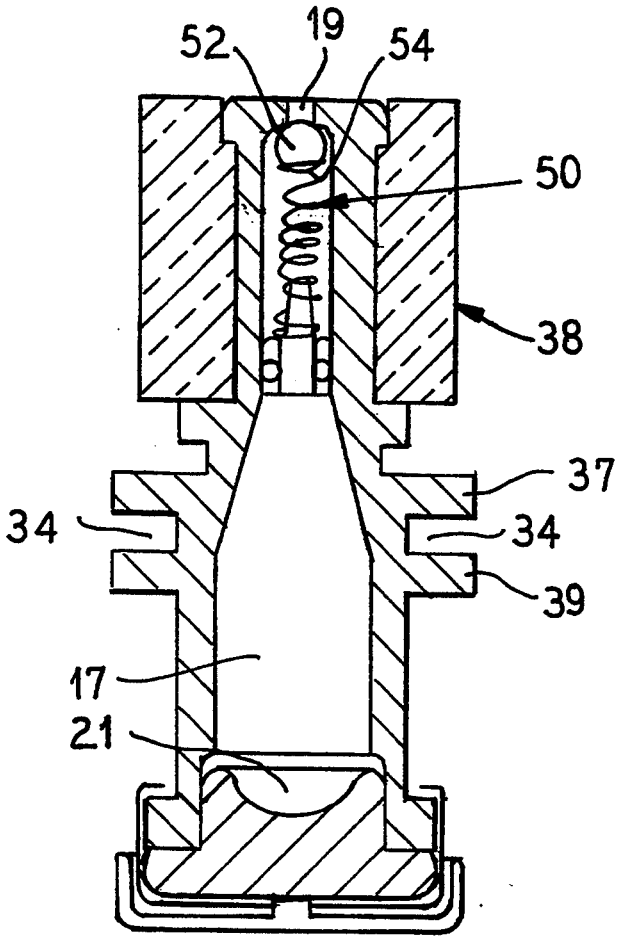
FIG. 4 is a sectional view of the fitment of the present invention with a ball check valve for blocking flow into the pouch.

FIG. 4 illustrates an alternate embodiment for the one-way check valve assembly. In this embodiment, a ball check valve assembly 50 is incorporated into the fitment 16. In the assembly 50, a ball 52 is located at the aperture 19 of the fitment body 16 connected to the pouch 12 on the interior side of the entry port 19. A spring 54 biases the ball 52 in a sealed relationship against the aperture 19 of the fitment 16 connected to the pouch 12 until the liquid is introduced to the fitment body 16 from the pouch 12.

When liquid is being drawn through the pouch 12 to the fitment body 16, the ball 52 of the ball check valve assembly 50 is forced toward opening 21 allowing liquid to flow through the channel 17 of the fitment body 16. The assembly 50, however, prevents the liquid from flowing back to the pouch 12 through the aperture 19.

Again, to seal the fitment 16 to the pouch 12 in the embodiment illustrated in FIG. 4, a sealing sleeve 38 is used. The sealing sleeve 38 may be attached to the fitment body 16 in this embodiment as previously discussed.

It should be understood that various changes and modifications to the presently preferred embodiments described herein will be apparent to those skilled in the art. Such changes and modifications can be made without departing from the spirit and scope of the present invention and without diminishing its attendant advantages. It is, therefore, intended that such changes and modifications be covered by the appended claims.

We claim:

1. An apparatus for storing and dispensing a liquid comprising:

a pouch formed from a heat sealable olefin plastic film defining an interior for holding the liquid;

a fitment constructed from a rigid plastic thermally welded to the pouch by a sealing sleeve, the sealing sleeve being constructed from a heat sealable plastic that is compatible with the heat sealable olefin plastic of the pouch; and a container having a top wall and a bottom wall parallel to the top wall, the container housing the pouch and at least a portion of the fitment and allowing the fitment to extend through an aperture of the bottom wall of the container into an area defining a recess of the container wherein the fitment extends into the recess but not beyond the recess.

2. The apparatus of claim 1 including a check valve for allowing fluid flow out of the pouch but preventing the reintroduction of the liquid into the pouch.

3. The apparatus of claim 2 wherein the check valve is secured to the sealing sleeve.

4. The apparatus of claim 2 wherein the check valve is coupled to the fitment.

5. The apparatus of claim 2 wherein the check valve is a ball check assembly located within the fitment.

6. The apparatus of claim 1 wherein the heat sealable olefin plastic and the rigid plastic have substantially equivalent barrier properties.

7. The apparatus of claim 1 further comprising:

a hole in the top wall of the container for allowing the container to be suspended.

8. The apparatus of claim 1 wherein the sealing sleeve is constructed from low density polyethylene.

9. The apparatus of claim 1 wherein the container has sufficient rigidity to protect the pouch and its contents from environmental stresses.

10. A container including a fitment comprising:

a body having an interior constructed from a heat sealable flexible olefin material;

a fitment constructed from a rigid material that is not easily heat sealed to the heat sealable flexible olefin material; and a sleeve for coupling the fitment to the body wherein the sleeve is heat sealed to the heat sealable flexible olefin material of the body and is secured to the fitment, the fitment extending into the sleeve forming fluid communication between the interior of the body and the fitment.

11. The container of claim 10 further comprising:

a rigid container constructed and arranged to receive the body.

12. The container of claim 11 wherein the rigid container is constructed from cardboard.

13. The container of claim 10 wherein the fitment is constructed from a material chosen from the group consisting of: PBT; and PETG.

14. The container of claim 10 wherein the sleeve is constructed from low density polyethylene.

15. The container of claim 10 further comprising:

means for allowing fluid flow out of an interior of the container through the fitment but preventing the introduction of fluid into the interior of the body through the fitment, the means for allowing fluid flow constructed and arranged near an end of the fitment.

16. A method for manufacturing a container having a fitment, the method comprising the steps of:

creating a pouch having an interior from a flexible olefin material;

creating a fitment from a rigid plastic material not easily heat sealable to the flexible olefin material; and securing the fitment to the pouch by use of a sleeve heat sealed to the flexible clef in material and is secured to the fitment such that the fitment extends into the sleeve forming fluid communication between the interior of the pouch and the fitment.

17. The method of claim 16 wherein the sleeve is secured to the fitment by being directly injection molded thereto.

18. The method of claim 16 wherein the sleeve is secured to the fitment by being adhesive bonded thereto.

19. The method of claim 16 wherein the sleeve is welded to the fitment.

20. The method of claim 16 wherein the sleeve is press fit to the fitment.

21. The method of claim 16 including the step of locating the container inside the rigid container and allowing the fitment to extend from an opening therein.

22. A container including a fitment comprising:

a body having an interior constructed from a heat sealable flexible olefin material;

a fitment constructed from a rigid material that is not easily heat sealed to the heat sealable flexible olefin material; and a sleeve for coupling the fitment to the body wherein the sleeve is heat sealed to the heat sealable flexible olefin material of the body and is secured to the fitment; and a rigid container constructed and arranged to receive the body wherein the rigid container includes an aperture at a bottom thereof, the aperture allowing access to the fitment when the body is located in the rigid container.

* * * * *